United States Patent [19]

Shafai et al.

[11] Patent Number: 4,982,198

[45] Date of Patent: Jan. 1, 1991

[54] HIGH PERFORMANCE DIPOLE FEED FOR REFLECTOR ANTENNAS

[75] Inventors: Lotfollah Shafai, Winnipeg; Prakash Bhartia, Ottawa, both of Canada

[73] Assignee: Her Majesty the Queen in right of Canada, as represented by the Minister of National Defence, Ottawa, Canada

[21] Appl. No.: 349,463

[22] Filed: May 9, 1989

[30] Foreign Application Priority Data

May 16, 1988 [CA] Canada ..... 566934

[51] Int. Cl.[5] ..... H01Q 19/19

[52] U.S. Cl. ..... 343/818; 343/837; 343/840

[58] Field of Search ..... 343/837, 840, 781 P, 343/834, 838, 818, 819

[56] References Cited

U.S. PATENT DOCUMENTS 2,115,788 5/1938 Scharlau ..... 343/837
2,370,053 2/1945 Lindenblad ..... 343/838
2,460,869 2/1949 Braden ..... 343/840
3,742,512 6/1973 Munson ..... 343/840

FOREIGN PATENT DOCUMENTS 578018 6/1946 United Kingdom ..... 343/837

OTHER PUBLICATIONS

Kidal, "Dipole-Disk Antenna with Beam-Forming Ring", IEEE Transactions on Antennas and Propagation, Jul. 1982, vol. AP-30, p. 529.

*Primary Examiner*—Michael C. Wimer
*Attorney, Agent, or Firm*—Michael Zelenka; Robert A. Maikis

[57] ABSTRACT

A dipole feed for a paraboloidal reflector antenna uses a conical reflector to direct the radiation of the dipole towards the concave reflecting surface of the parabola. The size and apex angle of the conical reflector are optimized to yield the desired feed pattern, the optimization parameters depending on the reflector size and focal length and being obtained numerically or experimentally to maximize reflector gain.

3 Claims, 2 Drawing Sheets

HIGH PERFORMANCE DIPOLE FEED FOR REFLECTOR ANTENNAS

BACKGROUND OF THE INVENTION

1. Field of the Invention

The present invention relates to paraboloidal reflector antennas, and more particularly to dipole feeds for such antennas.

2. Description of the Prior Art

Paraboloid antennas, consisting of a dish-shaped surface illuminated by a feed horn mounted at the focus of the reflector, are commonly used in microwave communication applications involving line-of-sight transmission facilities operating at frequencies higher than 960 MHz. Since the performance of this type of antenna is closely related to its feed, the feed has to be designed for high antenna efficiency and low cross-polarization, which can be achieved with a feed having symmetric E-plane and H-plane radiation patterns.

Dipole feeds have been used extensively as the feeds for paraboloidal reflector antennas, particularly where such antennas have radar and low frequency applications. The dipole, being approximately one-half wavelength long, is split at its electrical center for connection to the transmission line. The radiation pattern of the dipole is a maximum at right angles to the axis of the antenna. In virtually all current designs, the dipole feed is used with a reflecting disk or a reflecting rod which propagates the radiation field towards the reflector. Such designs are structurally simple and thus relatively rugged and easy to fabricate, but have the disadvantage of generating unequal E-plane and H-plane patterns, which illuminate the reflector surface in an asymmetric manner and thereby cause high reflector cross-polarization, high side and back lobe levels, and a low reflector gain factor.

More recently, a common design for the feed makes use of a circular waveguide having a corrugated flange to improve the efficiency thereof. The geometry of such a feed is, however, relatively complex, and consequently the feed is expensive and difficult to fabricate. In addition, the corrugated feed must be supported by struts that cause aperture blockage, which normally reduces the antenna gain and increases the cross-polarization and the side lobe levels.

Accordingly, it is desirable to be able to design a low cost dipole feed which would offer weight and cost advantages over existing designs, especially at low microwave frequencies. One such improvement to the design of dipole feeds was recently described by Kildal in "Dipole-Disk Antenna with Beam-Forming Ring", IEEE Transactions on Antennas and Propagation, July 1982, Vol AP-30, p. 529, whereby an additional ring in front of the dipole is used to improve the radiation pattern. This dipole feed, however, provides relatively narrow beams and also emits a comparatively high level of back radiation.

SUMMARY OF THE INVENTION

Briefly, the present invention relates to a dipole feed for a paraboloidal reflector antenna, wherein a conical reflector directs the radiation of the dipole towards the concave reflecting surface of the parabola. The size and apex angle of the conical reflector are optimized to yield the desired feed pattern, the optimization parameters depending on the reflector size and focal length and being obtained numerically or experimentally to maximize reflector gain.

More particularly, the present invention relates to a dipole feed for a paraboloidal reflector antenna, the antenna having a concave reflecting surface, comprising a half-wave electric dipole to generate a radiation pattern, and a reflecting element behind the dipole to direct the radiation pattern towards the parabola of the antenna, the reflecting element having a substantially conical shape.

DESCRIPTION OF THE PREFERRED EMBODIMENT OF THE INVENTION

Figure 1:
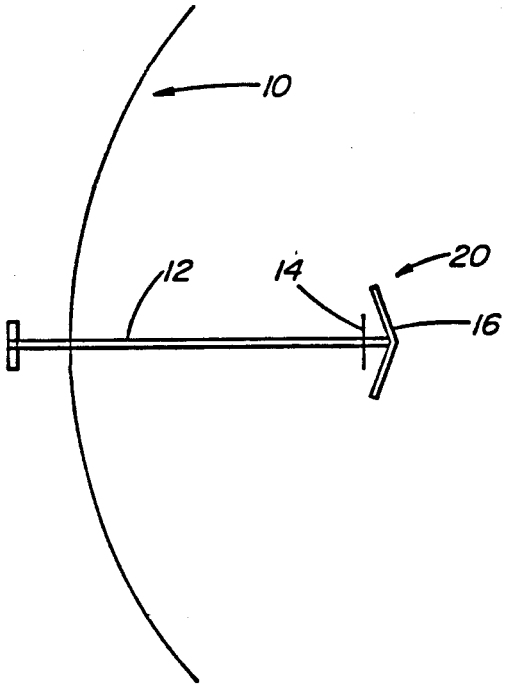
FIG. 1 schematically depicts a paraboloidal reflector antenna and the dipole feed therefor of the present invention.

FIG. 1 depicts the geometry of a reflector antenna 10 and a dipole feed assembly of the present invention, shown generally as 20. A central feed line 12 is used to support a dipole 14 and a conical reflector 16. Feed line 12 additionally serves as a means of delivering the signal power to dipole 14, but the power to dipole 14 can, in other embodiments, be supplied through an external cable. The depicted central support configuration simplifies the geometry of the feed assembly and minimizes the reflector blockage; however, if desired, strut supports could also be utilized.

Figure 2:
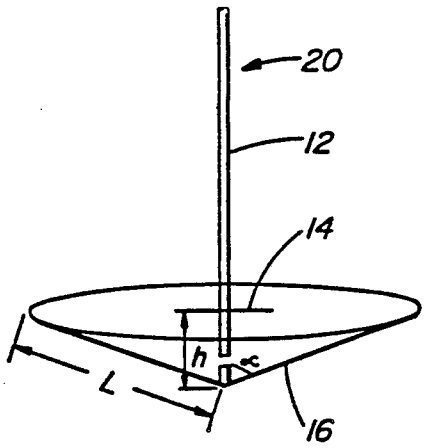
FIG. 2 schematically depicts one embodiment of the dipole feed of the present invention.

FIG. 2 depicts dipole feed assembly 20 with a simple conical reflector 16. The parameters which are optimized are the distance h of dipole 14 from the apex of conical reflector 16, the apex angle $\alpha$ of conical reflector 16, and the side length L of conical reflector 16. The actual optimized dimensions of reflector 16 depend on the paraboloid geometry, namely, the ratio of the focal length to reflector aperture diameter, known as the F/D ratio. For paraboloidal antennas where the F/D ratio is around 0.4, it can be determined that the optimal dimensions for conical reflector 16 comprise an apex angle $\alpha$ of about 70°, a side length L of about one wavelength in length, and a dipole separation distance h of about 0.3 wavelength. Accordingly, at a frequency of, for example, 1.0 GHz, wavelength $\lambda$ is 30 cm, and thus $L=1\lambda=30$ cm, $h=0.3\lambda=9.0$ cm, and $d=0.25\lambda=7.5$ cm. The reflector diameter is normally selected having regard to the gain requirement, feed assembly 20 operating with any size reflector as long as the F/D ratio is kept the same.

For paraboloidal antennas of different F/D ratio, the dimensions of conical reflector 16 can readily be modified, either experimentally or by numerical analysis techniques known to persons skilled in the art, to maximize the reflector gain. One numerical method that can be used for optimizing the feed is based on a moment method, whereby the dipole radiation field is used to determine the current distribution on the reflecting cone. The total feed radiation is calculated by adding the radiation field of the cone to that of the dipole. Various cone geometries can then be considered to determine an optimum conical size and shape.

Figure 3:
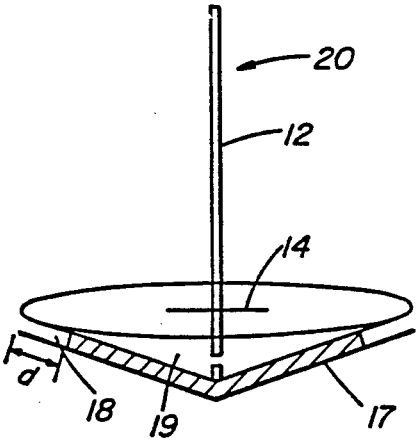
FIG. 3 schematically depicts another embodiment of the dipole feed of the present invention.

Conical reflector 16, described above, improves the dipole pattern of assembly 20, but still exhibits a level of back radiation which may be too high for some applications. To further reduce the back radiation, a modified conical reflector 17 depicted in FIG. 3 can be utilized with dipole feed assembly 20. A slot ring or choke 18 of depth d, being about a quarter of a wavelength, is imbedded in conical wall 19 to prevent a current flow behind conical reflector 17. This reduces the feedback radiation to levels around −30 dB. The cross-polarization of the modified dipole feed using reflector 17 is generally small and also less than −30 dB.

Figure 4:
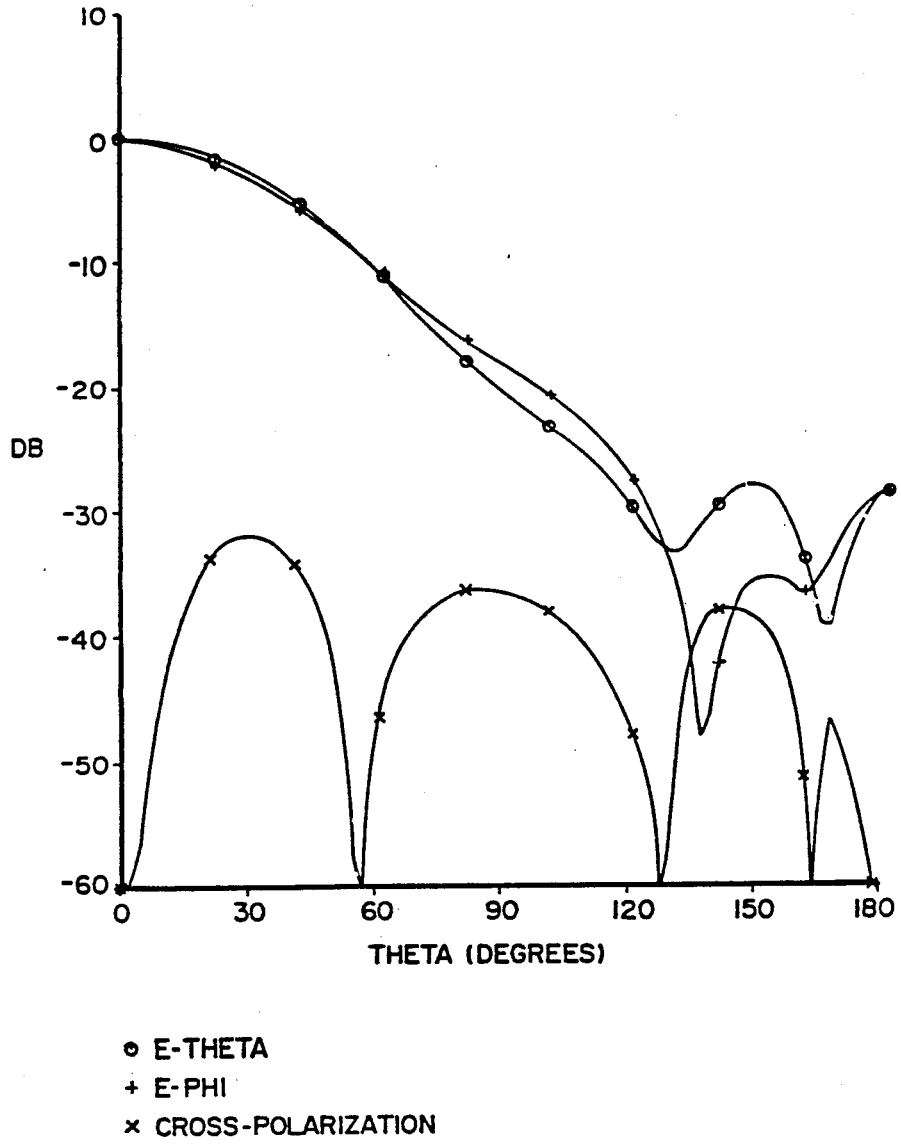
FIG. 4 illustrates an example of the radiation pattern of the dipole feed depicted in FIG. 3.

An example of the radiation pattern generated by a feed using reflector 17, in both the E-plane and H-plane, and the cross-polarization in the 45° plane therefor, is illustrated in FIG. 4.

The components for dipole feed assemblies 10 and 20 can be fabricated primarily from aluminum material, with dipole 14 being fabricated from brass. Other appropriate materials well known to persons skilled in the art can also be used, but aluminum has the advantage of being comparatively light and thus reducing the cone weight.

The dipole feed with conical reflector herewith disclosed has a very low cross-polarization, emits low side and back radiation, and provides high reflector gain factors; thus, the present design may, in some applications, replace corrugated feeds. Whereas standard dipole feeds provide a reflector aperture efficiency of about 73% and cross-polarization higher than −20 dB, the optimized dipole feed raises the aperture efficiency to about 85% and reduces the cross-polarization to less than −30 dB. The reflector gain factor increases by a ratio similar to that of the improvement of the aperture efficiency. In addition, the geometry of the present design is comparatively simple and consequently the finished article is relatively rugged.

The foregoing has shown and described particular embodiments of the invention, and variations thereof will be obvious to one skilled in the art. Accordingly, the embodiments are to be taken as illustrative rather than limitative, and the true scope of the invention is as set out in the appended claims.

What is claimed is:

1. A dipole feed paraboloidal reflector antenna system comprising:

a paraboloidal reflector antenna having a central axis and a concave reflecting surface, said reflector antenna having a ratio of focal length to reflector aperture diameter of about 0.4;

a half-wave electric dipole radiating element disposed on said central axis of said paraboloidal reflector antenna for generating a radiation pattern; and a reflecting element disposed on said central axis for directing a portion of said radiation pattern from said radiating element towards said concave surface, said reflecting element having a substantially conical shape with an apex and a wall depending from said apex, said apex being spaced a greater distance from said concave surface along said central axis than said wall, said reflecting element having a conical apex angle of about 70° between said central axis and said wall and a length of about one wavelength of said radiation pattern, said dipole radiating element being disposed on said central axis between the concave surface of said reflector antenna and said reflecting element at a distance of about three-tenths of said wavelength from said apex of said reflecting element.

2. The dipole feed reflector antenna system of claim 1, wherein said reflecting element has formed in the wall thereof a substantially circumferential slot ring.

3. The dipole feed reflector antenna system of claim 2, wherein said slot ring has a depth of about one quarter of a wavelength of said radiation pattern.

* * * * *